US006982384B2

(12) United States Patent
Hall et al.

(10) Patent No.: US 6,982,384 B2
(45) Date of Patent: Jan. 3, 2006

(54) LOAD-RESISTANT COAXIAL TRANSMISSION LINE

(75) Inventors: David R. Hall, Provo, UT (US); Joe Fox, Spanish Fork, UT (US)

(73) Assignee: IntelliServ, Inc., Provo, UT (US)

( * ) Notice: Subject to any disclaimer, the term of this patent is extended or adjusted under 35 U.S.C. 154(b) by 127 days.

(21) Appl. No.: 10/605,373

(22) Filed: Sep. 25, 2003

(65) Prior Publication Data

US 2005/0067159 A1 Mar. 31, 2005

(51) Int. Cl.
*H01B 7/18* (2006.01)

(52) U.S. Cl. ..... 174/102 R; 385/854.9

(58) Field of Classification Search ..... 174/15.1, 174/15.4, 15.5, 21 R, 25 R, 25 G, 28, 36, 174/102 R, 74 R, 78; 385/854.9
See application file for complete search history.

(56) References Cited

U.S. PATENT DOCUMENTS

| | | | | |
|---|---|---|---|---|
| 749,633 | A | | 1/1904 | Seeley |
| 1,539,490 | A | * | 5/1925 | Vassar ..... 427/105 |
| 2,178,931 | A | | 11/1939 | Crites et al. |
| 2,197,392 | A | | 4/1940 | Hawthorn |
| 2,249,769 | A | | 7/1941 | Leonardon |
| 2,301,783 | A | | 11/1942 | Lee |
| 2,354,887 | A | | 8/1944 | Silverman et al. |
| 2,379,800 | A | | 7/1945 | Hare |
| 2,414,719 | A | | 1/1947 | Cloud |
| 2,437,482 | A | | 3/1948 | Salisbury |
| 2,531,120 | A | | 11/1950 | Feaster |
| 2,633,414 | A | | 3/1953 | Boivinet |
| 2,659,773 | A | | 11/1953 | Barney |
| 2,662,123 | A | | 12/1953 | Koenig, Jr. |
| 2,748,358 | A | | 5/1956 | Johnston |
| 2,974,303 | A | | 3/1961 | Dixon |
| 2,982,360 | A | | 5/1961 | Morton et al. |
| 3,079,549 | A | | 2/1963 | Martin |
| 3,090,031 | A | | 5/1963 | Lord |
| 3,170,137 | A | | 2/1965 | Brandt |
| 3,186,222 | A | | 6/1965 | Martin |
| 3,194,886 | A | | 7/1965 | Mason |
| 3,209,323 | A | | 9/1965 | Grossman, Jr. |
| 3,227,973 | A | | 1/1966 | Gray |
| 3,253,245 | A | | 5/1966 | Brandt |
| 3,518,608 | A | | 6/1970 | Papadopoulos |
| 3,591,704 | A | * | 7/1971 | Ebel ..... 174/8 |
| 3,693,250 | A | * | 9/1972 | Brorein et al. ..... 29/825 |
| 3,696,332 | A | | 10/1972 | Dickson, Jr. et al. |
| 3,734,794 | A | * | 5/1973 | Ebel ..... 156/53 |
| 3,773,965 | A | * | 11/1973 | Reyonlds ..... 174/25 G |

(Continued)

*Primary Examiner*—William H. Mayo, III
(74) *Attorney, Agent, or Firm*—Jeffery E. Daly

(57) ABSTRACT

A transmission line for downhole tools that make up all or part of a tool string for drilling and production of oil, gas, and geothermal wells that can withstand the dynamic gravitational forces and other accelerations associated with downhole excavations. The transmission line has a metal tube, or outer conductor, that houses a coaxial wire inner conductor. A non-metallic dielectric material is interposed between the inner and outer conductors. The outer and inner conductors and the dielectric are sufficiently compressed together so that independent motion between them is abated. Compression of the components of the transmission line may be achieved by drawing the transmission through one or more dies in order to draw down the outer conductor onto the dielectric, or by expanding the inner conductor against the dielectric using a mandrel or hydraulic pressure. Non-metallic bead segments may be used in aid of the compression necessary to resist the dynamic forces and accelerations of drilling.

22 Claims, 8 Drawing Sheets

U.S. PATENT DOCUMENTS 3,793,632 A 2/1974 Still
3,807,502 A 4/1974 Heilhecker et al.
3,864,507 A * 2/1975 Fox et al. ..... 174/14 R
3,879,097 A 4/1975 Oertle
3,930,220 A 12/1975 Shawhan
3,957,118 A 5/1976 Barry et al.
3,962,529 A * 6/1976 Kubo ..... 174/15.6
3,985,948 A * 10/1976 Olszewski et al. ..... 174/28
3,989,330 A 11/1976 Cullen et al.
4,012,092 A 3/1977 Godbey
4,043,031 A * 8/1977 Friedrich et al. ..... 29/870
4,048,807 A * 9/1977 Ellers et al. ..... 405/159
4,087,781 A * 5/1978 Grossi et al. ..... 340/853.7
4,095,865 A 6/1978 Denison et al.
4,121,193 A 10/1978 Denison
4,126,848 A 11/1978 Denison
4,161,704 A 7/1979 Schafer
4,215,426 A 7/1980 Klatt
4,220,381 A 9/1980 van der Graaf
4,340,773 A 7/1982 Perreault
4,348,672 A 9/1982 Givler
4,445,734 A 5/1984 Cunningham
4,496,203 A 1/1985 Meadows
4,537,457 A 8/1985 Davis, Jr. et al.
4,578,675 A 3/1986 MacLeod
4,605,268 A 8/1986 Meador
4,660,910 A 4/1987 Sharp et al.
4,683,944 A 8/1987 Curlett
4,698,631 A 10/1987 Kelly, Jr. et al.
4,716,960 A * 1/1988 Eastlund et al. ..... 166/60
4,722,402 A 2/1988 Weldon
4,785,247 A 11/1988 Meador et al.
4,788,544 A 11/1988 Howard
4,806,928 A 2/1989 Veneruso
4,884,071 A 11/1989 Howard
4,901,069 A 2/1990 Veneruso
4,914,433 A 4/1990 Galle
4,924,949 A 5/1990 Curlett
5,008,664 A 4/1991 More et al.
5,052,941 A 10/1991 Hernandez-Marti et al.
5,148,408 A 9/1992 Matthews
5,248,857 A 9/1993 Ollivier
5,278,550 A 1/1994 Rhein-Knudsen et al.
5,302,138 A 4/1994 Shields
5,311,661 A 5/1994 Zifferer
5,332,049 A 7/1994 Tew
5,334,801 A 8/1994 Mohn
5,355,720 A * 10/1994 Bailey ..... 73/40
5,371,496 A 12/1994 Tanamachi
5,393,929 A * 2/1995 Yagihashi ..... 174/36
5,454,605 A 10/1995 Mott
5,455,573 A 10/1995 Delatorre
5,505,502 A 4/1996 Smith et al.
5,517,843 A 5/1996 Winship
5,521,592 A 5/1996 Veneruso
5,568,448 A 10/1996 Tanigushi et al.
5,650,983 A 7/1997 Kondo et al.
5,691,712 A 11/1997 Meek et al.
5,743,301 A 4/1998 Winship
RE35,790 E 5/1998 Pustanyk et al.
5,810,401 A 9/1998 Mosing et al.
5,833,490 A 11/1998 Bouldin
5,853,199 A 12/1998 Wilson
5,856,710 A 1/1999 Baughman et al.
5,898,408 A 4/1999 Du
5,908,212 A 6/1999 Smith et al.
5,924,499 A 7/1999 Birchak et al.
5,942,990 A 8/1999 Smith et al.
5,946,798 A * 9/1999 Buluschek ..... 29/828
5,955,966 A 9/1999 Jeffryes et al.
5,959,547 A 9/1999 Tubel et al.
5,971,072 A 10/1999 Huber et al.
6,030,004 A 2/2000 Schnock et al.
6,041,872 A 3/2000 Holcomb
6,045,165 A 4/2000 Sugino et al.
6,046,685 A 4/2000 Tubel
6,057,784 A 5/2000 Schaaf et al.
6,104,707 A 8/2000 Abraham
6,108,268 A 8/2000 Moss
6,123,561 A 9/2000 Turner et al.
6,141,763 A 10/2000 Smith et al.
6,173,334 B1 1/2001 Matsuzaki et al.
6,177,882 B1 1/2001 Ringgenberg et al.
6,188,223 B1 2/2001 van Steenwyk et al.
6,196,335 B1 3/2001 Rodney
6,209,632 B1 4/2001 Holbert et al.
6,223,826 B1 5/2001 Chau et al.
6,367,565 B1 4/2002 Hall
6,392,317 B1 5/2002 Hall et al.
6,405,795 B2 6/2002 Holbert et al.
6,489,554 B1 * 12/2002 Bertini et al. ..... 174/15.6
6,641,434 B2 11/2003 Boyle et al.
6,655,464 B2 12/2003 Chau et al.
6,670,880 B1 12/2003 Hall et al.
2002/0135179 A1 9/2002 Boyle et al.
2002/0193004 A1 12/2002 Boyle et al.
2003/0070842 A1 4/2003 Bailey et al.
2003/0168240 A1 * 9/2003 Ono et al. ..... 174/102 R
2003/0213598 A1 11/2003 Hughes

* cited by examiner

LOAD-RESISTANT COAXIAL TRANSMISSION LINE

FEDERAL RESEARCH STATEMENT

This invention was made with government support under Contract No. DE-PC26-01NT41229 awarded by the U.S. Department of Energy. The government has certain rights in the invention.

BACKGROUND OF INVENTION

1. Field of the Invention

This disclosure is related to a transmission line for downhole tools such as are associated with drill pipes in a tool string. More particularly, this disclosure relates to a semi-rigid transmission line that is capable of withstanding the tensile stresses, dynamic accelerations, and gravitational loads experienced by the downhole tools when drilling an oil, gas, or geothermal well.

2. Description of the Related Art

The transmission line of this disclosure is provided by placing the various components of the transmission line in sufficient contact with each other that independent motion between them is abated during use.

It has long been the unrealized goal of the drilling and subterranean excavation industries to achieve a real time, high data rate transmission of information from the excavation tool to the surface control systems. For example, in drilling wells, an information stream traveling to and from the drill bit would aid the driller in determining the condition of the drill bit, the nature of the formations being drilled, hazardous conditions developing in the formation and drill string, the condition of the drill string in general, and aid the driller in sending commands to the drill bit and related downhole equipment in order to steer the bit in the direction desired. An important element of such a real time network is a high-speed transmission line.

Transmission lines consisting of wire and coaxial cable have generally been proposed in prior disclosures. Coaxial systems are preferred for their utility and potential for transmitting a signal at high data rates. A coaxial cable is usually comprised of an inner conductive member, a dielectric region, and an outer conductor. Often the cable is encased within a jacket for ease of handling and as an extra measure of protection during use. The inner and outer components are usually comprised of conductive metal. Copper, aluminum, brass, gold, and silver, or combinations thereof, are the preferred materials that make up the conductors. Higher strength materials, such as steel, stainless steel, beryllium copper, Inconel, tungsten, chrome, nickel, titanium, magnesium, palladium, etc., and combinations thereof, have also been used for these components.

Theoretically, the most efficient dielectric region would consist of a gas having a dielectric constant of about 1.0. The dielectric constant of the materials used in the dielectric region is inversely related to the rate of signal propagation along the cable, e.g., the lower the constant, the higher the rate of signal transmission. But an exclusively gaseous system is impractical since in it there would be no means of maintaining the concentricity of the center conductor. Therefore, dielectric materials having low dielectric constants such as polymers and ceramics have been proposed for use in the dielectric region. A substantially porous dielectric may be preferred over a substantially non-porous dielectric in some applications because of its likelihood of increasing the gaseous content of the dielectric, thereby lowering the dielectric constant of the region and increasing the potential velocity of signal propagation along the length of the transmission line.

U.S. Pat. No. 2,437,482 incorporated by reference herein for all it discloses, to Salisbury, discloses the use of insulating beads is taught and a method is provided for configuring the inner and outer conductors to overcome the effects of the beads on signal propagation. U.S. Pat. No. 4,161,704 incorporated by reference herein for all it discloses, to Schafer, shows a transmission line is provided having electronic circuit components such as filters encapsulated therein. The disclosure also teaches the use of fluoropolymer foam dielectric materials such as Teflon®. This disclosure also teaches that in the process of manufacturing the cable, the outer conductor and dielectric region are mechanically reduced by drawing them through a die so as to contact each other and the center conductor. U.S. Pat. No. 4,340,773 incorporated by reference herein for all it discloses, to Perresult, discloses a small diameter dielectric system composed of a first layer of cellular polyparabanic acid that provides a skin surrounding the inner conductor. A second layer of a crosslinkable polymeric lacquer provides a skin enclosing the first layer. In this manner a strong, micro-diameter cable may be produced. U.S. Pat. No. 5,946,798 incorporated by reference herein for all it discloses, to Buluschek, provides for a method of manufacturing the core of the coaxial transmission line. A strip of conductive materials is shaped into a tube and then welded along its seam. After welding the tube undergoes a calibrations step to shape the core into a circular cross section.

In downhole applications, methods have been disclosed for providing electrical conductors along the length drill pipe and other tools. Coaxial transmission line cables have been recommended as the preferred conductor and an integral component for any system seeking to achieve high data rate transmission. The following are exemplary disclosures of these suggested applications.

U.S. Pat. No. 2,379,800 incorporated by reference herein for all it discloses, to Hare, discloses the use of a protective shield for conductors and coils running along the length of the drill pipe. The shield served to protect the conductors from abrasion that would be caused by the drilling fluid and other materials passing through the bore of the drill pipe.

U.S. Pat. No. 4,095,865 incorporated by reference herein for all it discloses, to Denison et al. discloses an improved drill pipe for sending an electrical signal along the drill string. The improvement comprised putting the conductor wire in a spiral conduit sprung against the inside bore wall of the pipe. The conduit served to protect the conductor and provided an annular space within the bore for the passage of drilling tools.

U.S. Pat. No. 4,445,734 incorporated by reference herein for all it discloses, to Cunningham, teaches an electrical conductor or wire segment imbedded within the wall of the liner, which secures the conductor to the pipe wall and protects the conductor from abrasion and contamination caused by the circulating drilling fluid. The liner of the reference was composed of an elastomeric, dielectric material that is bonded to the inner wall of the drill pipe.

U.S. Pat. No. 4,924,949 incorporated by reference herein for all it discloses, to Curlett, discloses a system of conduits along the pipe wall. The conduits are useful for conveying electrical conductors and fluids to and from the surface during the drilling operation.

U.S. Pat. No. 6,392,317 incorporated by reference herein for all it discloses, to Hall, et al., the applicants of the present disclosure, discloses an annular wire harness incorporating a coaxial transmission line connected to one or more rings for use in transmitting high-speed data along a drill string. The coaxial transmission line is connected to the rings that comprise a means for inductively coupling segmented drilling tools that make up the drill string.

In order to make a downhole transmission line practical, the cable of the transmission line must be able to withstand the dynamic conditions of downhole drilling. The transmission line cables that have been proposed in the art have not provided for the harsh environment that will be encountered downhole. Therefore, it is the object of this invention to provide a transmission line cable that can reliably deliver high data rate transmission in a downhole environment where high tensile stresses, rapid accelerations, and high, intermittent gravitational loads are present.

SUMMARY OF INVENTION

This disclosure presents a semi-rigid transmission line for downhole tools that are associated in a drill string, tool string, bottom hole assembly, or in a production well. The downhole tools, in reference to a drill sting, are joined together at tool joints, and in order to transmit information and power along the tool string, it is necessary to provide a transmission system that includes means for bridging the connected tool joints and a transmission line that is capable of elongation, that is impervious to abrasive fluids, and that is resistant to the dynamic gravitational forces and acceleration ever present in the downhole environment. Such a transmission line is presented herein consisting of tensile components comprising an outer conductor, a dielectric, and an inner conductor. The outer conductor may be a metal tube adapted for high electrical conductivity; the dielectric is preferably a fluoropolymer or a ceramic material having a low dielectric constant. Since a gas such as air has the lowest dielectric constant, it would be the preferred dielectric. Therefore, a foam or porous material may be used to achieve the lowest dielectric constant possible. The center conductor is a metal wire preferably having electrical properties at least about that of aluminum and copper. Hollow, solid, and multiple strand center conductors have useful properties in this disclosure. The center conductor may be coated in order to improve its electrical conductivity. The improvement of this disclosure is to provide a transmission line that is resistant to the dynamic loads of the tool string. This is achieved by placing the components of the coaxial line in sufficient contact with each other that independent motion between them is substantially abated. It is believed that at least about between 0.001" and 0.005" of diametric interference is required to substantially abate independent motion.

DETAILED DESCRIPTION

Figure 1:
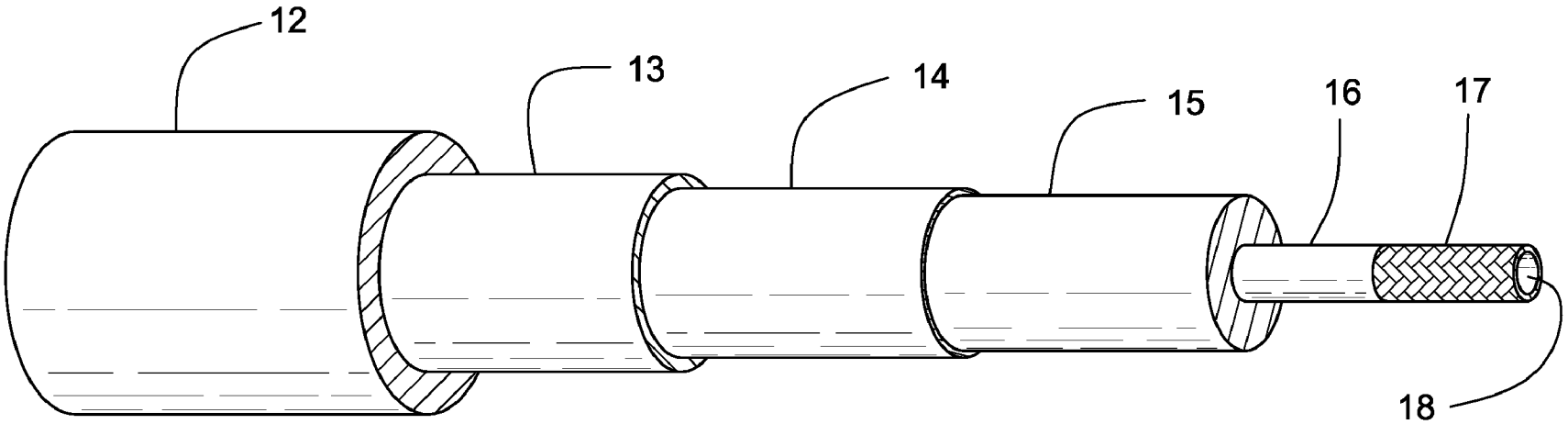
FIG. 1 is a perspective, telescoping representation of the transmission line of the present invention.

A tool string for drilling oil, gas, and geothermal wells consists of interconnected sections of downhole tool components associated with drill pipe. The tool string may also comprise coiled tubing, which is a continuous length of tubing. The chief advantage of coiled tubing is that it eliminates the segmented composition of the tool string in so far as it may relate to the drill pipe. However, even in coiled tubing applications, it is necessary to connect up to downhole tools in order to obtain full the utility of the varied downhole tools required to successfully drill a well. Whether in a segmented or continuous configuration, a downhole transmission line for transmitting data up and down the tool string must be capable of withstanding the dynamic conditions of drilling. These dynamic conditions include high tensile stresses, due to the suspended mass of the tool string, where the elastic strain is believed to be at least about 0.3%; rapid accelerations associated with the loading and unloading of the tool string and drill bit, and gravitational forces that may approach 500 g's. Therefore, the components of the transmission line must be able to withstand these conditions for an extended period of time, since drilling may proceed uninterrupted for 100 hours or more and since the life of some downhole tools is about 5 years.

The semi-rigid transmission line of this disclosure is designed to meet the requirements of extended life in the downhole environment. The transmission line may be adapted for use in any of the various downhole tools that are associated in a drill string, tool string, bottom hole assembly, or in equipment placed in a production well. In a segmented tool string, the downhole tools are joined together at tool joints, and in order to transmit information and power along the tool string, it is necessary to provide a transmission line that is compatible with the tool joints and tool joint make up. Like the tool body, itself, the transmission line must also be capable of elongation, be resistant to corrosion and wear, and provide reliable service when subjected to repeated gravitational forces and accelerations ever present in the downhole environment. The transmission line of this disclosure comprises components consisting of a metal outer conductor having the mechanical strength of the annular drill pipe and other downhole tools, and a Teflon®, or similar fluorine polymer, dielectric material that encases an inner conductor having similar mechanical properties of the outer conductor.

It is believed that efficiency in the design of the transmission line of the present invention may be achieved by combining the mechanical properties of the outer conductor with the electrical properties of the inner conductor. Therefore, a preferred outer conductor may comprise a metal tube that is lined with a material having high electrical conductivity, or it may consist of a tube within a tube, for example a strong metal tube having an aluminum or copper tube inserted therein. Nevertheless, the applicants have found that a steel tube of 300 series stainless steel is an acceptable conductor for short distances.

Though air is the most preferred dielectric, it is also the most impractical in the coaxial configuration. However, the more air spaces in the dielectric material the more useful it may become in terms of transmission line impedance. Therefore, a porous material may be preferred to a solid material, though a solid material may also be tuned for high efficiency in accordance with the requirements of the system. A porous ceramic material may be used for the dielectric sleeve.

Although, the center conductor is usually a fine diameter wire of less than 0.050", it must also be strong and electrically conductive. A steel core wire having a coating of copper, silver, or gold, or combination thereof, is preferred. Such a wire would nearly match the mechanical properties of the outer conductor and yet have the high electrical conductivity required for high-speed data transmission. In the coaxial configuration, the signal travels only along the outer skin of the inner conductor and along the inner skin of the outer conductor; this is known as the "skin effect". This phenomenon permits the use of high strength materials for the conductor components of the transmission line when those components are combined with materials that have high electrical properties at least about that of aluminum and copper. Hollow, solid, and multiple strand electrical components used in the center conductors may be useful in furnishing strength and facilitating connectivity to the other components that make up the transmission line.

Since an object of this disclosure is to provide a transmission line that is resistant to the dynamic loads of drilling, this is achieved by placing the components of the coaxial line in sufficient contact with each other that independent motion between them is substantially abated. It is believed that at least about 0.001" diametric interference is required to substantially abate independent motion. These and other aspects of this invention will be made more apparent in reference to the following drawings.

The drawings are offered by way of example and not by way of limitation. Those skilled in the art will undoubtedly recognize the breadth of the utility of this disclosure, and will realize uses and modifications to the present invention that are not explicitly described herein. It is understood that these related aspects of this invention, although not explicitly described herein, are nonetheless part of the invention disclosed.

FIG. 1 is a perspective, telescoping representation of a transmission line of the present invention. It depicts a braided center core 17 having an alternative protective sheath 16. The protective sheath may be conducting or non-conducting and may act as a transition interface between the core material and the dielectric that provides a strong bondable surface and may protect the dielectric region from wear during use. The center conductor may consist of multiple wires in a stranded or braded configuration, either presenting a substantially solid or hollow configuration. The materials of transmission line must be able to strain together at least about 0.3%. In FIG. 1, the core 17 is shown with a cavity 18 at its center. The sheath 15 may also impregnate the interstices of the braid or strands giving the core added strength and resilience and at the same time providing greater bonding area for the dielectric material. Surrounding the core of the transmission line is the dielectric region composed of a low-constant dielectric material. A solid or foam fluoropolymer is preferred in this application, but a ceramic may also be useful especially one that has reinforcing, non-conductive fibers for added strength and flexibility.

Adjacent the dielectric region is disposed a highly conductive material 14 measuring at least 60% of the International Annealed Copper Standard (IACS). This conductor may take the form of a discrete foil-like wrap or it may be bonded to the inside surface of the outer conductor 13. The outer conductor 13 is preferably a metal tube. Materials such as steel, stainless steel, beryllium copper, Inconel, tungsten, chrome, nickel, titanium, magnesium, and palladium, and combinations thereof, have been used for both inner and outer conductors. These materials may be adapted for high electrical conductivity by placing them adjacent to high conductivity materials or by coating them with such materials, such as silver and copper.

In FIG. 1, the inside surface of the tube 13 is coated with a highly conductive material 14, similar to that of the inner conductor, such as copper or a copper silver alloy. A method of achieving this configuration would be to place a copper tube inside the outer conductor and mechanically deform the two materials into intimate contact. Another method would be by plating the copper and silver onto the inside surface of the stainless steel tube or by impregnating the copper into the steel tube. Since in the coaxial orientation, the electronic signal travels along the inside surface portion of the outer conductor and along the outside surface portion of the inner conductor, a substantial portion of these conductors may be made up of high strength materials, usually having low conductivity, as long as surface portions are highly conductive. It may be desirable to encase the entire transmission line within a protective jacket 12. Normally, the jacket would be of a non-conductive material, highly resilient and corrosive resistant.

Figure 2:
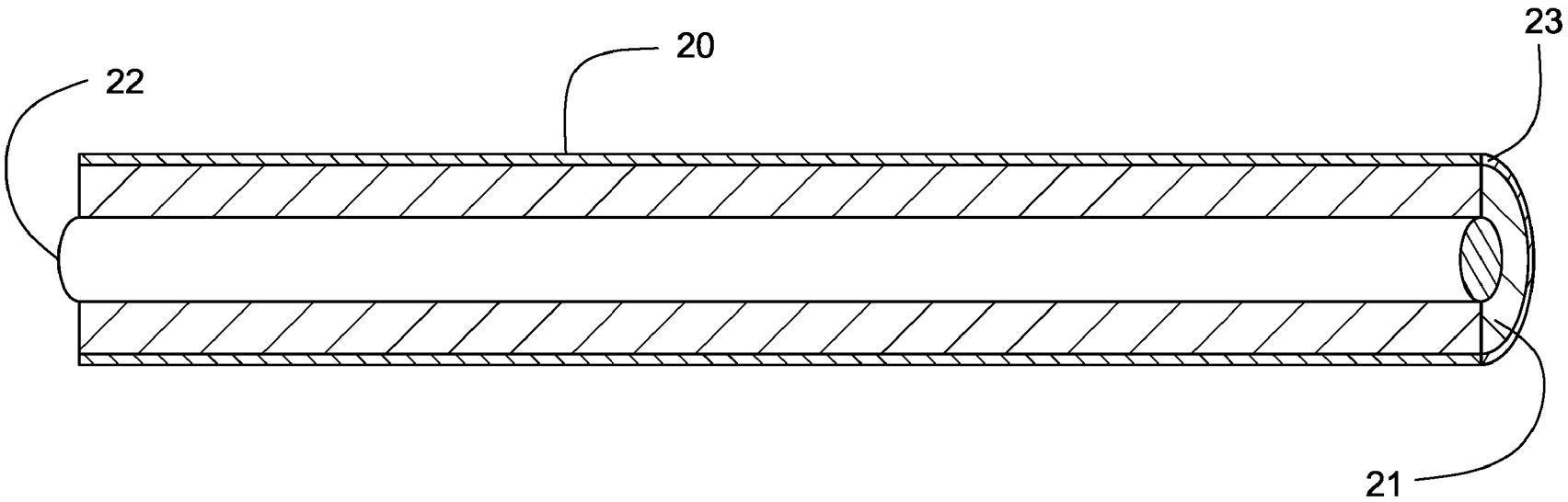
FIG. 2 is a perspective, sectioned view of the transmission line of the present invention.
Figure 8:
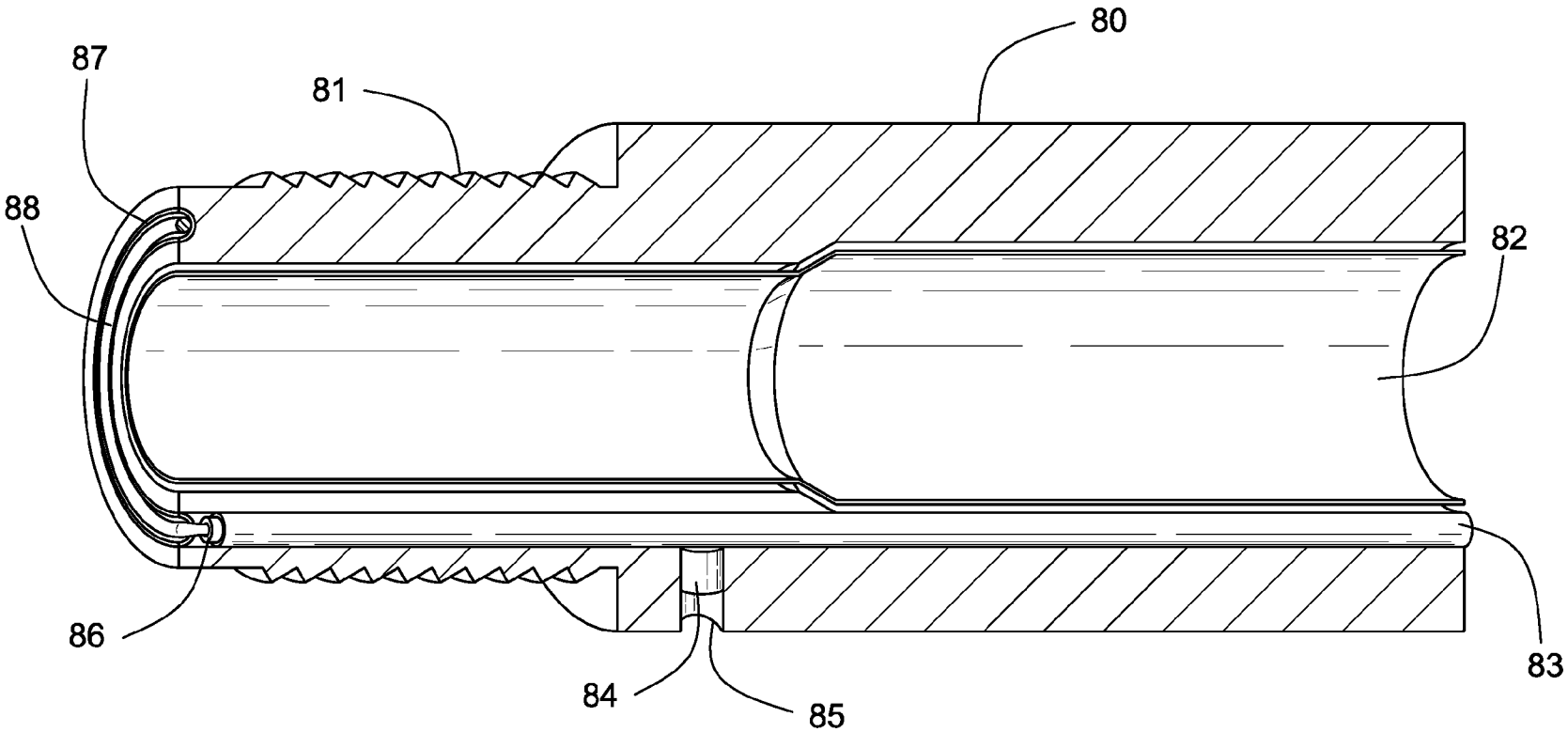
FIG. 8 is section of a pin end tool joint depicting an inductive coupling method of bridging the connected tool joint and methods of retaining the transmission line within the downhole tools.

FIG. 2 is a perspective, sectioned view of a transmission line of the present invention similar to that shown in FIG. 1, but without the protective jacket 12. The inner conductor 22 is a solid in this view. The dielectric region 21 is adjacent the conductor 22, and the outer conductor 20 features an inside coating of conductive material 23 such as copper or an alloy of silver and copper. The applicants have found that a stainless steel outer conductor 20 may also serve as the primary path for the electrical signal over short distances even though its conductivity may be less than 30% IACS. In a downhole tool string, the individual tool segments are generally between 30 and 45 feet long. The transmission line segments would, therefore, be of similar lengths. Although not shown in this view, the ends of the transmission line are adaptable for connection to mechanisms for transmitting the signal from one tool segment to another tool segment as shown in FIG. 8, and in the applicants U.S. Pat. No. 6,392,317.

Figure 3:
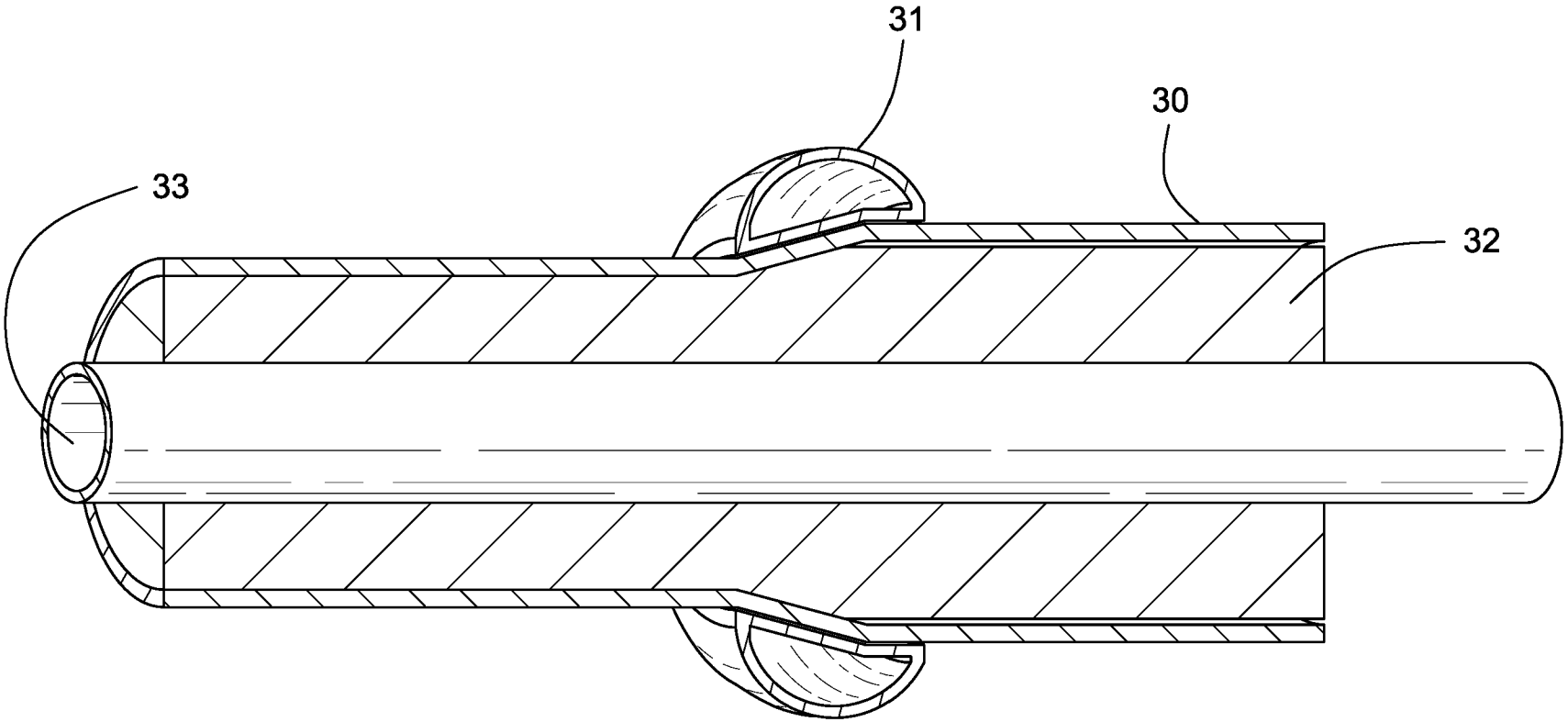
FIG. 3 is a section view of a method of compressing the components of the transmission line.

FIG. 3 is a sectioned view of the transmission line of FIGS. 1 and 2 depicting a method of compressing the components of the transmission line in order to abate independent motion between them during use. A hollow center conductor 33 is disposed coaxially with an outer conductor 30 having a dielectric material 32 disposed intermediate the inner and outer conductors. The center conductor 33 may feature a roughened exterior so as to increase its surface contact with the dielectric. The rough exterior may be produced by knurling or by bead or grit blasting. It may also be achieved by coating the conductor with a non-uniform coat of a polymeric material. The assembled components of the transmission line are drawn through a die 31 in order to reduce the diameter of the outer conductor 30, placing the dielectric material 32 in compression against the inner, center conductor 33 and outer conductors 30. A diametric interference of at least between about 0.001 and 0.005 inches is required for sufficient contact between the components in order to abate independent motion between the components. The interference between the outer conductor and the dielectric material may also be achieved by hydraulic pressure along the length of the outer conductor by the process known as hydroforming. Or the transmission line could be drawn through a series of roll forms in to obtain the desired compression. The center conductor 33 may be hollow or solid. A hollow center conductor 33 may be used as a receptacle for connection to an inductive coupling mechanism for connecting the transmission line of one segmented tool to another tool as the tool string is made up.

The hollow core center conductor 33 may also be used to place the components in compression. A mandrel may be drawn through the center conductor 33 to expand it out against the dielectric 32 thereby creating the same degree of interference achieved by drawing the assembled components through a die 31. Alternatively, the hollow core center conductor 33 may be expanded out using hydraulic pressure in a hydroforming operation in order to achieve the contact required to resist the dynamic accelerations and gravitational loads experienced during a drilling operation. Furthermore, the core center conductor 33 may be coated with a non-conductive polymeric transition material in order to increase the bond strength with the dielectric. A temperature resistant, high strength fluoropolymer, for example polytetrafluoroethylene (PTFE), may be applied in a thin coat along the outer surface of the center conductor 33 before the components are made up into a transmission line. Likewise, a thin coat of PTFE may be applied to the inside surface of the outer conductor 30 in order to accommodate compression and to increase the bond strength between the outer conductor 30 and the dielectric 32.

Figure 4:
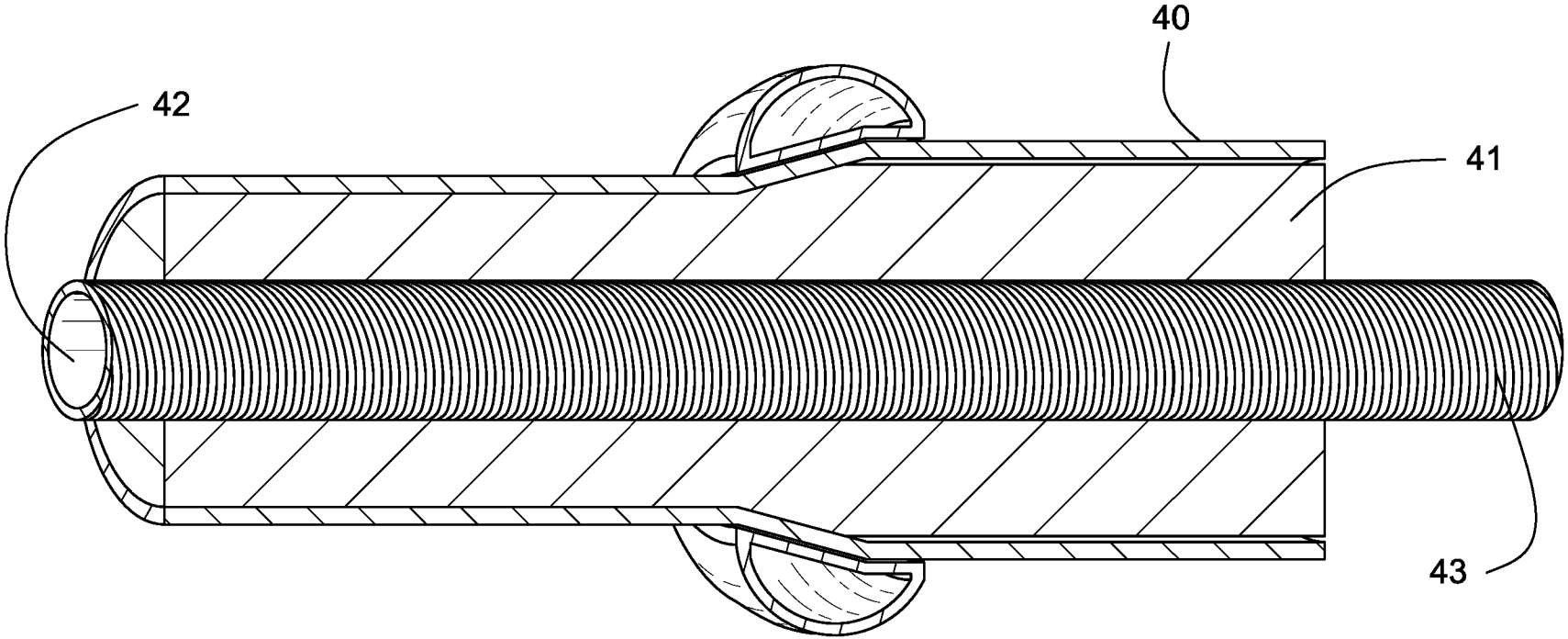
FIG. 4 is a section view of a transmission line of the present invention having hollow inner conductor comprising strands of wire.

FIG. 4 is a section view of a transmission line of the present invention having outer conductor 40, a dielectric region 41, and a hollow core 42. The center conductor in this view presents conductive windings 43 along its length. Alternatively, the winding may be positioned along the inside surface of the inner conductor. In this configuration the inner conductor could be a high strength metal or a polymeric tube with the signal path being through the windings.

Figure 5:
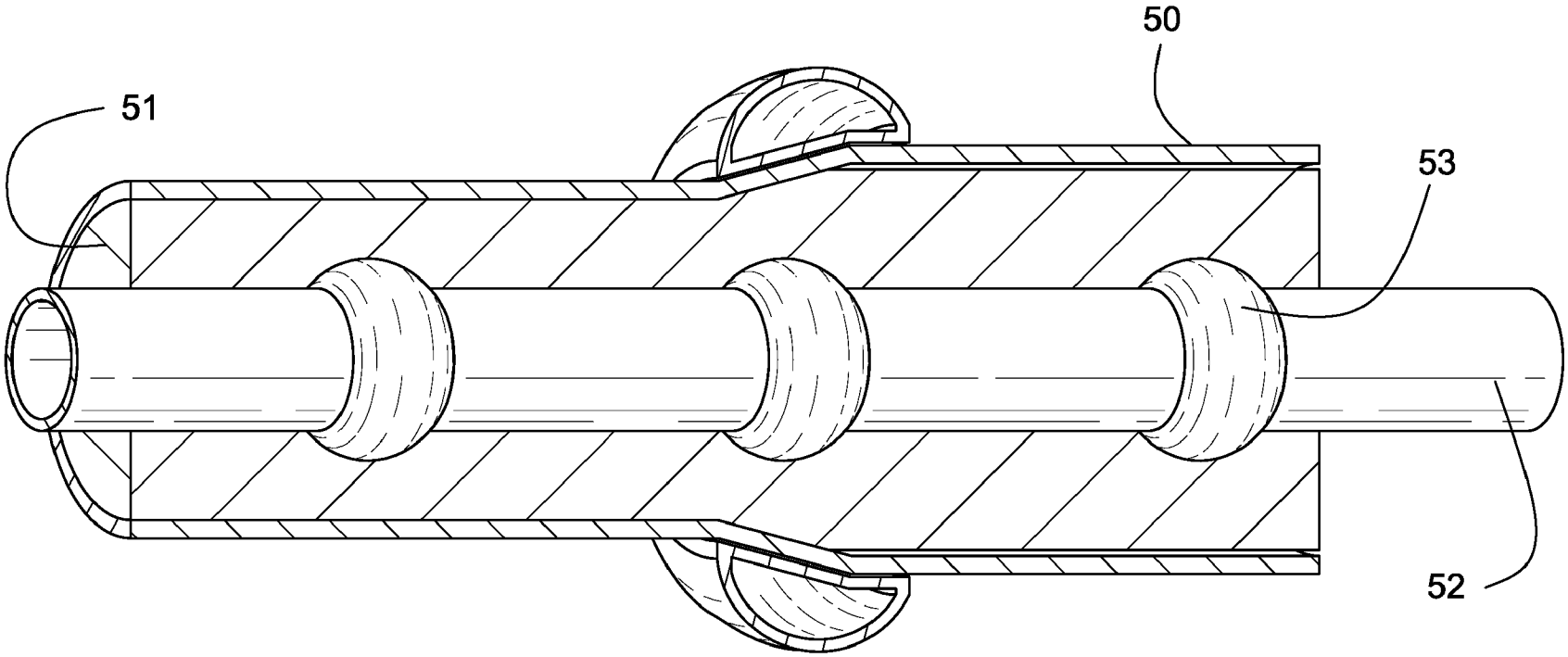
FIG. 5 is a section view of a transmission line of the present invention having non-conductive beads along the center conductor as a means of increasing resistance to gravitational forces and accelerations.

FIG. 5 is a section view of a transmission line of the present invention. It depicts a coated outer conductor 50, a dielectric 51, and a center conductor 52 adapted for high contact with the dielectric using beads 53. This periodic bead configuration using non-conductive materials serves as a means for increasing resistance to gravitational forces and accelerations that are experienced by the transmission line during downhole use.

Figure 6:
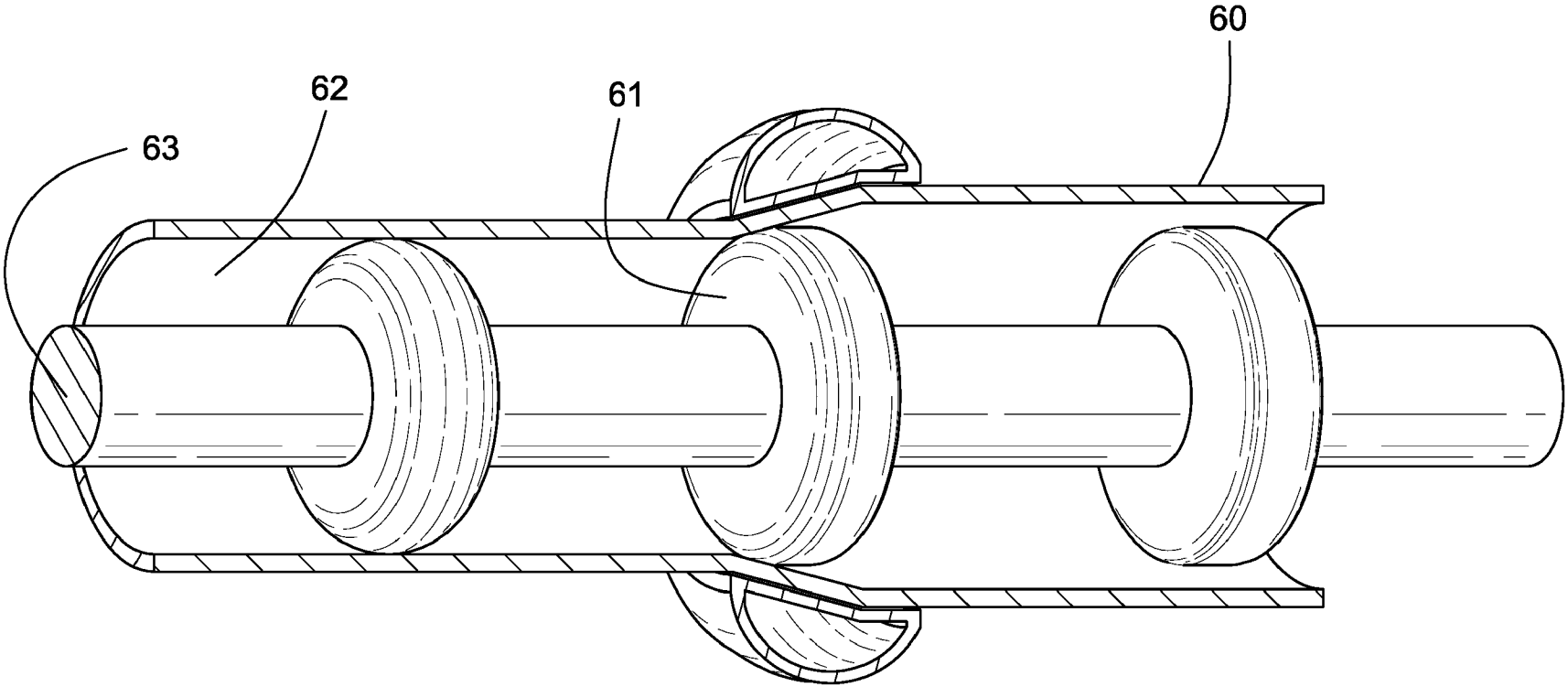
FIG. 6 is a section view of a transmission line of the present invention having non-conductive segments in a gaseous dielectric region to aid in achieving high compression within the interior of the transmission line.

FIG. 6 is a section view of a transmission line of the present invention having an outer metal conductor 60 that is lined with a high conductivity material, a solid center conductor 63, comprising a similar highly conductive material, and non-conductive segments 61 in a gaseous dielectric region 62. The segments serve to maintain the concentricity of the center conductor and provide for mechanical stabilization of the components during use. As the diameter of the outer conductor is reduced through a die, providing an interference of say 0.003", the segments 61 are placed in compression against both the outer and inner conductors. Analysis of this configuration suggests that such an interference fit would be sufficient to resist the dynamic loads associated with downhole tools during use as well as provide for a low dielectric constant for high transmission line efficiency.

Figure 7:
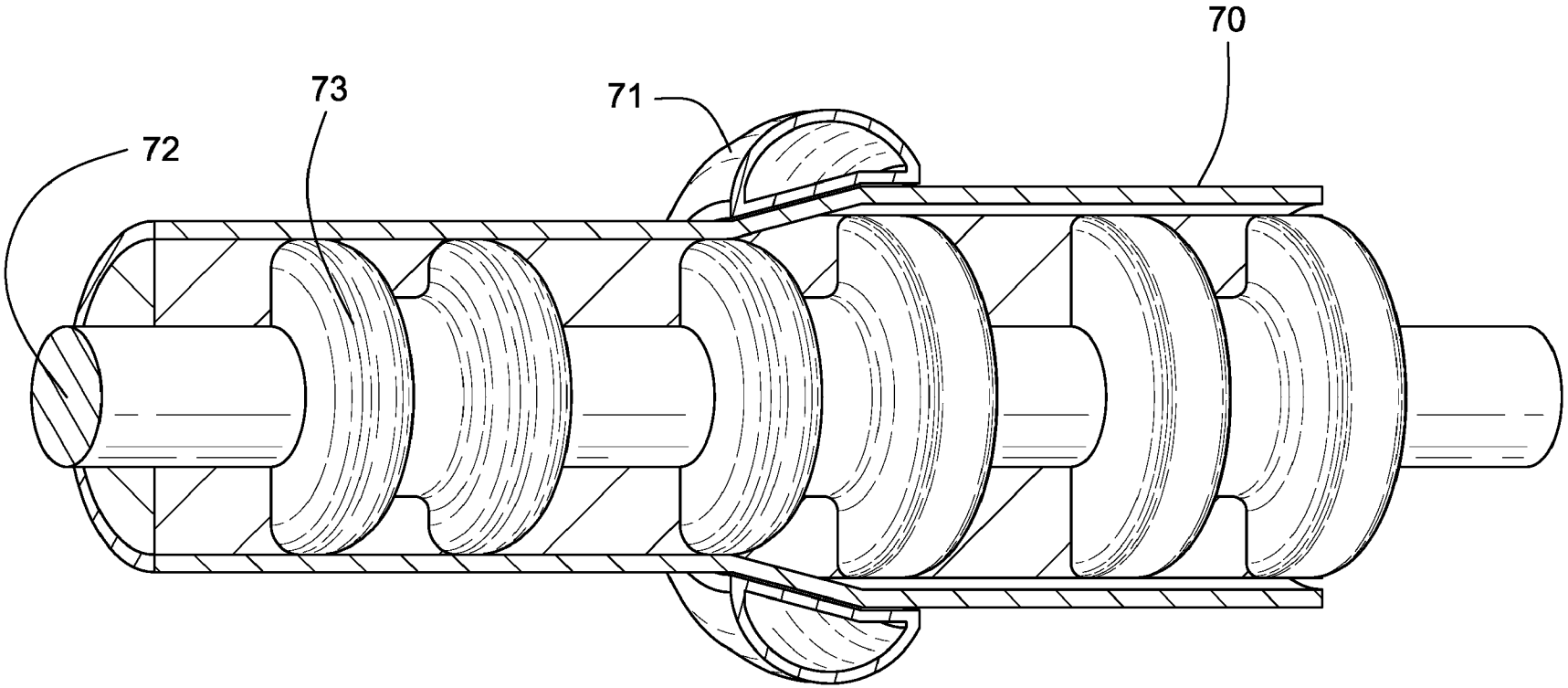
FIG. 7 illustrates another configuration of the nonconductive segments used on cooperation with a nonporous dielectric.

FIG. 7 depicts a cross-section of a transmission line of the present invention having an outer conductor 70 being drawn through a die 71 which provides a compression fit on spool-like segments 73 that are placed periodically along the center conductor 72. When coaxial transmission lines are fabricated with a thin foil shield adjacent the dielectric and the outer conductor, the foil is used as the path for the "skin effect," and the outer conductor serves to protect the shield from damage during handling and use. The foil shield is usually in the form of a braided sleeve or a solid tape that is wound around the dielectric material. When such a configuration is drawn though the compression die, the slightest interference between the shield, the dielectric and the outer conductor tends to cause the shield to bunch up and tear. The spool-like segments 73 configuration shown in FIG. 7 is thought to reduce the friction and strain on the shield and allow the outer conductor to be drawn down without damaging the other internal components of the transmission line. Spool-like segments 73 may take a variety of shapes different from those shown in the figure without departing from the spirit of this disclosure.

FIG. 8 is a representation of a cross-section view of a pin-end tool joint 80, having threads 81 for mechanical connection to a mating downhole tool and a liner 82 for improving hydraulic flow and for protecting the tool from corrosion and damage during use. An outer conductor of the present invention 83 is shown disposed along the inside wall of the tool joint. Several methods are depicted for attaching the conductor to the tool. For example, a plug 86 that is configured to allow the coaxial components of the transmission line to exit the plug for connection to an inductive coupling mechanism 87 that includes a conductive coil 88 that are positioned within an annular trough located in the secondary shoulder of the joint. The plug 86 may be tapered, barbed, or threaded as a means for capturing the tube 83 within the tool 80. Another method for attaching the transmission line to the tool is shown by the clamping device 84 that is provided through a cross port 85 in the wall of the joint. Like the plug, it too may be tapered, threaded, or barbed in order to achieve sufficient clamping force on the tube 83. Also, the liner 82 may be used to secure and protect the transmission line along the inside wall of the downhole tool. Both the liner and the tube may have rough outside surfaces to increase the friction between the adjoining components. Any of these methods may be used to secure the transmission line to the tool or they may be used in combination with each other.

Whereas the present invention has been described in particular relation to the drawings attached hereto, it should be understood that other and further modifications apart from those shown or suggested herein, may be made within the scope and spirit of the present invention.

What is claimed is:

1. A transmission line for a downhole tool, the transmission line comprising a generally tubular outer conductor with a high strength material adjacent a highly conductive material; an inner conductor generally co-axially disposed within the outer conductor, and a dielectric material disposed intermediate the inner and outer conductors, the dielectric material intially loosely fitted relative to at least one of the outer and the inner conductors; wherein at least one of the outer and the inner conductors is further deformed to provide an interference fit with the dielectric material, such that independent motion between the outer conductor, inner conductor, and the dielectric material is substantially abated during deployment of the downhole tool.

2. The transmission line of claim 1 wherein the downhole tool is selected from the group consisting of well casings, drill pipes, heavy weight drill pipes, drill collars, tool joints, jars, motors, turbines, batteries, shock absorbers, reamers, drill bits, pumps, hydraulic hammers, pneumatic hammers, electronic subs, logging subs, sensor subs, directional drilling subs, repeaters, swivels, nodes, repeaters, and downhole assemblies.

3. The transmission line of claim 1 , wherein the inner and the outer conductors comprise materials having electrical conductivity at least about 60% of the International Annealed Copper Standard (IACS).

4. The transmission line of claim 1, wherein an inside surface of the outer conductor is in contact with a material having electrical conductivity at least 60% of the IACS.

5. The transmission line of claim 1, wherein the inner conductor comprises a wire, a stranded wire, a braided wire, or a combination thereof.

6. The transmission line of claim 1, wherein the dielectric material is a substantially non-porous material.

7. The transmission line of claim 1, wherein the dielectric material is a substantially porous material.

8. The transmission line of claim 1, wherein the dielectric material comprises a gas.

9. The transmission line of claim 1, wherein the dielectric material comprises porous and/or non-porous, segmented beads.

10. The transmission line of claim 1, wherein the dielectric material comprises a gaseous material associated with a porous material.

11. The transmission line of claim 1, wherein the outer conductor has an outer surface, a portion of which exhibits a rough texture.

12. The transmission line of claim 1, wherein the outer conductor is attached to the downhole tool.

13. The transmission line of claim 12, wherein the outer conductor is attached to the downhole tool by a clamp connection or a plug connector.

14. The transmission line of claim 12, wherein the outer conductor is attached to the downhole tool by a threaded connector.

15. The transmission line of claim 12, wherein the outer conductor is attached to the downhole tool by a liner disposed within said downhole tool.

16. The transmission line of claim 1, wherein the interference between the outer conductor, the dielectric, and the inner conductor is a diametric interference of between about 0.001 and about 0.005 inches.

17. The tranamission line of claim 1, wherein to outer conductor, to dielectric, and the inner conductor are in sufficient contact to withstand gravitational loads of between 100 and 500 g's.

18. The transmission line of claim 1, wherein the inner conductor, the dielectric, an the outer conductor are capable of elastic strain of at least about 0.3%.

19. A transmission line for a downhole tool, the transmission line comprising a generally tubular outer conductor attached to the downhole tool; an inner conductor generally co-axially disposed within the outer conductor, and a dielectric material disposed intermediate the inner and outer conductors, the dielectric material initially loosely fitted relative to at least one of the outer and the inner conductors; wherein at least one of the outer and the inner conductors is further deformed to provide an interference fit with the dielectric material, and compressing the dielectric material such that independent motion between the outer conductor, inner conductor, and the dielectric material is substantially abated during deployment of the downhole tool.

20. The transmission line of claim 19, wherein the compression of the dielectric material is due to further deformation between the outer conductor and the inner conductor of between about 0.001 inches and about 0.005 inches.

21. The transmission line of claim 19, wherein the outer conductor is attached to the downhole tool by a clamp connection or a plug connector.

22. The transmission line of claim 19, wherein the outer conductor is attached to the downhole tool by a liner disposed within said downhole tool.

* * * * *